US007839375B2

(12) United States Patent
Lee et al.

(10) Patent No.: US 7,839,375 B2
(45) Date of Patent: Nov. 23, 2010

(54) MODIFYING IMAGE SIGNALS FOR DISPLAY DEVICE

(75) Inventors: Baek-Woon Lee, Yongin-si (KR); Young-Chol Yang, Seongnam-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1160 days.

(21) Appl. No.: 11/487,235

(22) Filed: Jul. 14, 2006

(65) Prior Publication Data

US 2007/0013636 A1 Jan. 18, 2007

(30) Foreign Application Priority Data

Jul. 14, 2005 (KR) ..... 10-2005-0063659

(51) Int. Cl.
*G09G 3/36* (2006.01)

(52) U.S. Cl. ..... 345/100; 345/87; 345/90; 345/89; 345/98

(58) Field of Classification Search ..... 345/87, 345/89, 90, 98, 100, 204, 530, 531, 541, 345/543, 547; 348/222.1
See application file for complete search history.

(56) References Cited

U.S. PATENT DOCUMENTS 4,633,416 A * 12/1986 Walker ..... 345/592
4,636,850 A * 1/1987 Stewart ..... 378/98.5
5,428,693 A * 6/1995 Murakami et al. ..... 382/232
5,459,529 A * 10/1995 Searby et al. ..... 348/586
5,596,687 A * 1/1997 Peters, Jr. ..... 345/582
5,621,428 A 4/1997 King et al.
6,304,245 B1 10/2001 Groenenboom
6,707,493 B1 * 3/2004 Lee et al. ..... 348/246
2002/0050965 A1 5/2002 Oda et al.
2003/0006994 A1 1/2003 Suzuki
2003/0058264 A1 3/2003 Takako et al.
2003/0098839 A1 5/2003 Lee
2004/0135800 A1 * 7/2004 Shiomi et al. ..... 345/691

(Continued)

FOREIGN PATENT DOCUMENTS

CN 1571008 A 1/2005

(Continued)

OTHER PUBLICATIONS

Patent Abstracts of Japan, Publication No. 09-054571, Feb. 25, 1997, 1 page.

(Continued)

*Primary Examiner*—Prabodh M Dharia
(74) *Attorney, Agent, or Firm*—Innovation Counsel LLP

(57) ABSTRACT

Disclosed is a display device together with a method of modifying image signals. The display device includes a plurality of pixels with first and second pixels, and an image signal modifier for generating a modified image signal by modifying the input image signal of the first pixel based on the previous image signal of the first pixel and the input image signal of the second pixel. Dynamic capacitance compensation is made for a pixel where the gray variation thereof with respect to the pixels neighboring thereto is low, but over-compensation that is greater than the dynamic capacitance compensation is made for a pixel where the gray variation thereof with respect to the pixel neighbors is high, thereby decreasing the blurring, and preventing the image quality from being deteriorated.

25 Claims, 8 Drawing Sheets

U.S. PATENT DOCUMENTS

| | | | | |
|---|---|---|---|---|
| 2004/0183761 | A1 | 9/2004 | Miyachi et al. | |
| 2005/0001812 | A1* | 1/2005 | Amundson et al. | 345/107 |
| 2005/0024353 | A1* | 2/2005 | Amundson et al. | 345/204 |
| 2005/0219184 | A1* | 10/2005 | Zehner et al. | 345/89 |
| 2005/0219408 | A1* | 10/2005 | Yang et al. | 348/441 |
| 2005/0275646 | A1* | 12/2005 | Pai et al. | 345/204 |
| 2006/0066554 | A1 | 3/2006 | Baba et al. | |
| 2008/0012955 | A1* | 1/2008 | Johnson et al. | 348/222.1 |
| 2008/0079675 | A1* | 4/2008 | Yang et al. | 345/87 |
| 2009/0096882 | A9* | 4/2009 | Johnson et al. | 348/222.1 |
| 2010/0165136 | A1* | 7/2010 | Johnson et al. | 348/222.1 |

FOREIGN PATENT DOCUMENTS

| | | | |
|---|---|---|---|
| EP | 1122711 | A | 8/2001 |
| EP | 1465149 | | 10/2004 |
| EP | 1467346 | | 10/2004 |
| JP | 9-054571 | | 2/1997 |
| JP | 11-272846 | | 10/1999 |
| JP | 2000-259143 | | 9/2000 |
| JP | 2000-330501 | | 11/2000 |
| JP | 2002-333605 | | 11/2002 |
| JP | 2003-177697 | | 6/2003 |
| JP | 2003-036055 | A | 7/2003 |
| JP | 2004-4640 | | 1/2004 |
| KR | 0155915 | | 7/1998 |
| KR | 10-0201291 | | 3/1999 |
| KR | 10-0400375 | | 9/2003 |
| KR | 2003-0074362 | | 9/2003 |
| KR | 2003-0076756 | | 9/2003 |
| KR | 10-2004-0039674 | | 5/2004 |
| WO | 2005020205 | | 3/2005 |
| WO | 2006025021 | | 3/2006 |

OTHER PUBLICATIONS

Patent Abstracts of Japan, Publication No. 11-272846, Oct. 8, 1999, 1 page.
Patent Abstracts of Japan, Publication No. 2000-259143, Sep. 22, 2000, 1 page.
Patent Abstracts of Japan, Publication No. 2000-330501, Nov. 30, 2000, 1 page.
Patent Abstracts of Japan, Publication No. 2002-333605, Nov. 22, 2002, 1 page.
Patent Abstracts of Japan, Publication No. 2003-177697, Jun. 27, 2003 , 1 page.
Patent Abstracts of Japan, Publication No. 2004-004640, Jan. 8, 2004 , 1 page.
Patent Abstracts of Korea, Publication No. 100155915 B1, Jul. 16, 1998, 1 page.
Patent Abstracts of Korea, Publication No. 100201291 B1, Mar. 12, 1999, 1 page.
Patent Abstracts of Korea, Publication No. 10-0400375, Sep. 22, 2003, 1 page.
Patent Abstracts of Korea, Publication No. 1020030074362 A, Sep. 19, 2003, 1 page.
Patent Abstracts of Korea, Publication No. 1020030076756, Sep. 29, 2003, 1 page.
Patent Abstracts of Korea, Publication No. 1020040039674 A, May 12, 2004, 1 page.

* cited by examiner

MODIFYING IMAGE SIGNALS FOR DISPLAY DEVICE

REFERENCE TO RELATED APPLICATION

This application claims priority to and the benefit of Korean patent application no. 10-2005-0063659 filed in the Korean intellectual property office on Jul. 14, 2005, the entire contents of which are incorporated herein by reference.

1. Field of the Invention

The present invention relates to a display device and a method of modifying image signals.

2. Description of the Related Art

Generally, a liquid crystal display ("LCD") includes two panels with pixel electrodes and a common electrode, and a liquid crystal layer disposed between the two panels and having dielectric anisotropy. The pixel electrodes are arranged in the form of a matrix, and are connected to switching elements such as thin film transistors (TFTs) to receive data signals sequentially per respective rows. The common electrode is formed on the entire surface of a panel to receive a common voltage. From the circuit perspective, the pixel and the common electrodes and the liquid crystal layer disposed therebetween form a liquid crystal capacitor, which functions as a basic unit for forming a pixel together with the switching element connected thereto.

Voltages applied to the electrodes form an electric field at the liquid crystal layer whose intensity varies the transmittance of light passing through the liquid crystal layer to display images. In order to prevent the liquid crystal layer from being adversely affected by the application of a long duration uni-directional electric field, the voltage polarity of the data signal with respect to the common voltage is inverted between frames, rows, or pixels.

As the LCDs have been widely used not only for computer display devices but also for television display devices, it is necessary to display mobile images therewith well. However, the response time of the LCD is too long to optimally display the mobile images. Furthermore, as the LCD is a hold type display device, the image is liable to be blurred when displaying the mobile images.

SUMMARY OF THE INVENTION

An embodiment of the present invention provides a liquid crystal display that shortens the response time of the liquid crystals and prevents the display image from being blurred. Recognizing that the dielectric constant and hence the capacitance of the liquid crystal layer at a pixel changes as the crystal molecules are oriented by the applied voltage, a finite time is required for the molecules to reach the target value of light transmittance. The larger the difference between the target light transmittance and the initial light transmittance of the pixel is, the greater the difference between the effective pixel voltage and the target pixel voltage becomes. Accordingly, it is required to make the data voltage applied to pixel higher or lower than the target data voltage, for instance, by way of a dynamic capacitance compensation (DCC).

According to one aspect of the present invention, the input image signal of a first pixel is modified based on a previous image signal and the image signal input to a second pixel. The modification represents the degree of gray variation in the input image signal of the first pixel with respect to the input image signal of the second pixel. The modification advantageously may be based on the image signal input to a third pixel neighboring the first pixel to express the same color as the color of the first pixel. A preliminary modification is based on a previous image signal and the difference between the preliminary modified signal and the previous image signal of the first pixel may be more than the difference between the input image signal of the first pixel and the previous image signal of the first pixel. The image signal modifier may further have a lookup table for storing the preliminary modified signal with respect to the pair of previous and input image signals of the first pixel.

The modified image signal may be produced by subtracting the input image signal of the first pixel from the preliminary modified signal, multiplying the subtracted value by the modification variable, and adding the input image signal of the first pixel to the multiplied value.

BRIEF DESCRIPTION OF THE DRAWINGS

The present invention may become more apparent from the ensuing description when read together with the drawing, in which.

DETAILED DESCRIPTION OF PREFERRED EMBODIMENTS

Figure 1:
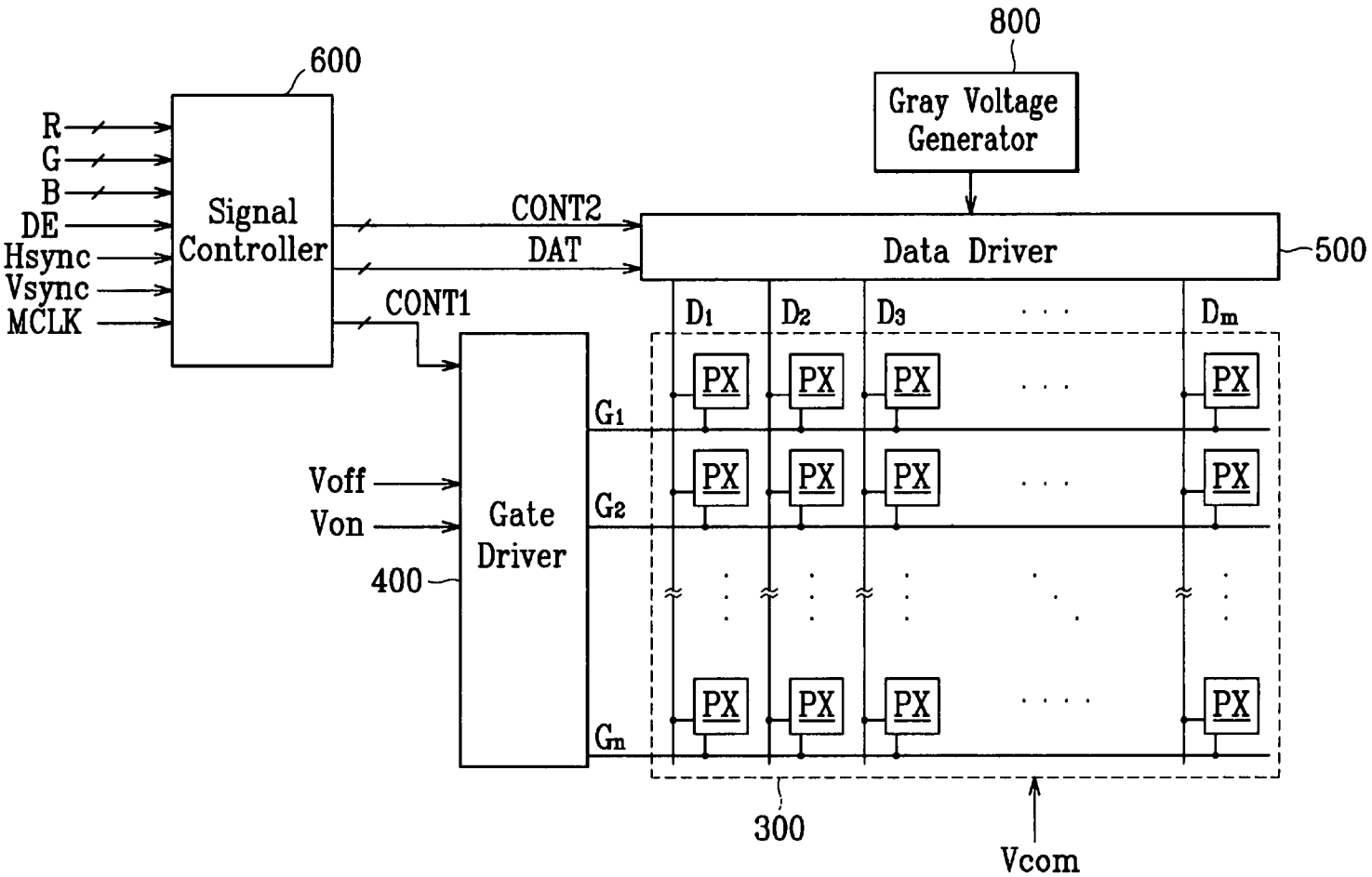
FIG. 1 is a block diagram of an LCD according to an embodiment of the present invention.

In the drawings, the thickness of layers, films, and regions are exaggerated for clarity. Like numerals refer to like elements throughout. It will be understood that when an element such as a layer, film, region, or substrate is referred to as being "on" another element, it can be directly on the other element or intervening elements may also be present. In contrast, when an element is referred to as being "directly on" another element, there are no intervening elements present.

As shown in FIG. 1, an LCD according to an embodiment of the present invention includes a liquid crystal panel assembly 300, gate drivers 400, data drivers 500, a gray voltage generator 800 connected to data driver 500, and a signal controller 600 for controlling them.

From the equivalent circuit perspective, the liquid crystal panel assembly 300 includes a plurality of gate lines G1-Gn and data lines D1-Dm arranged in a matrix, and a plurality of pixels PX at the intersections of the gate lines and data lines. Gate lines G1-Gn extend in the row direction parallel to each other, and data lines D1-Dm extend in the column direction parallel to each other. Gate lines G1-Gn deliver gate signals (also called the "scanning signals"), and the data lines D1-Dm for carry data signals.

The pixel PX is connected to the ith (i=1, 2, . . . , n) gate line Gi and the jth data line Dj (j=1, 2, . . . , m) includes a switching element Q connected to the signal lines Gi and Dj, and a liquid crystal capacitor $C_{LC}$ and a storage capacitor $C_{ST}$ connected thereto. When needed, the storage capacitor $C_{ST}$ may be omitted.

The switching element Q is a triode device such as a thin film transistor provided at the lower panel 100, which has a control terminal connected to gate line Gi, an input terminal connected to data line Dj, and an output terminal connected to the liquid crystal capacitor $C_{LC}$ and the storage capacitor $C_{ST}$.

The liquid crystal capacitor includes pixel electrode 191 of the lower panel 100 and a common electrode 270 of the upper panel 200 as two terminals liquid crystal layer 3 disposed between the two electrodes as the dielectric. Pixel electrode 191 is connected to the switching element Q, and the common electrode 270 is formed on the entire surface of the upper panel 200 to receive a common voltage Vcom. Different from the structure shown in FIG. 2, the common electrode 270 may be provided at the lower panel 100, and in this case, at least one of the two electrodes 191 and 270 may be formed in the shape of a line or a bar.

The storage capacitor $C_{ST}$ that is subsidiary to the liquid crystal capacitor $C_{LC}$ is formed by overlapping a separate signal line (not shown) provided at the lower panel 100 with pixel electrode 191 while interposing an insulator. A predetermined voltage such as a common voltage Vcom is applied to the separate signal line. However, the storage capacitor $C_{ST}$ may be formed by overlapping pixel electrode 191 with the just previous gate line while interposing an insulator.

Figure 2:
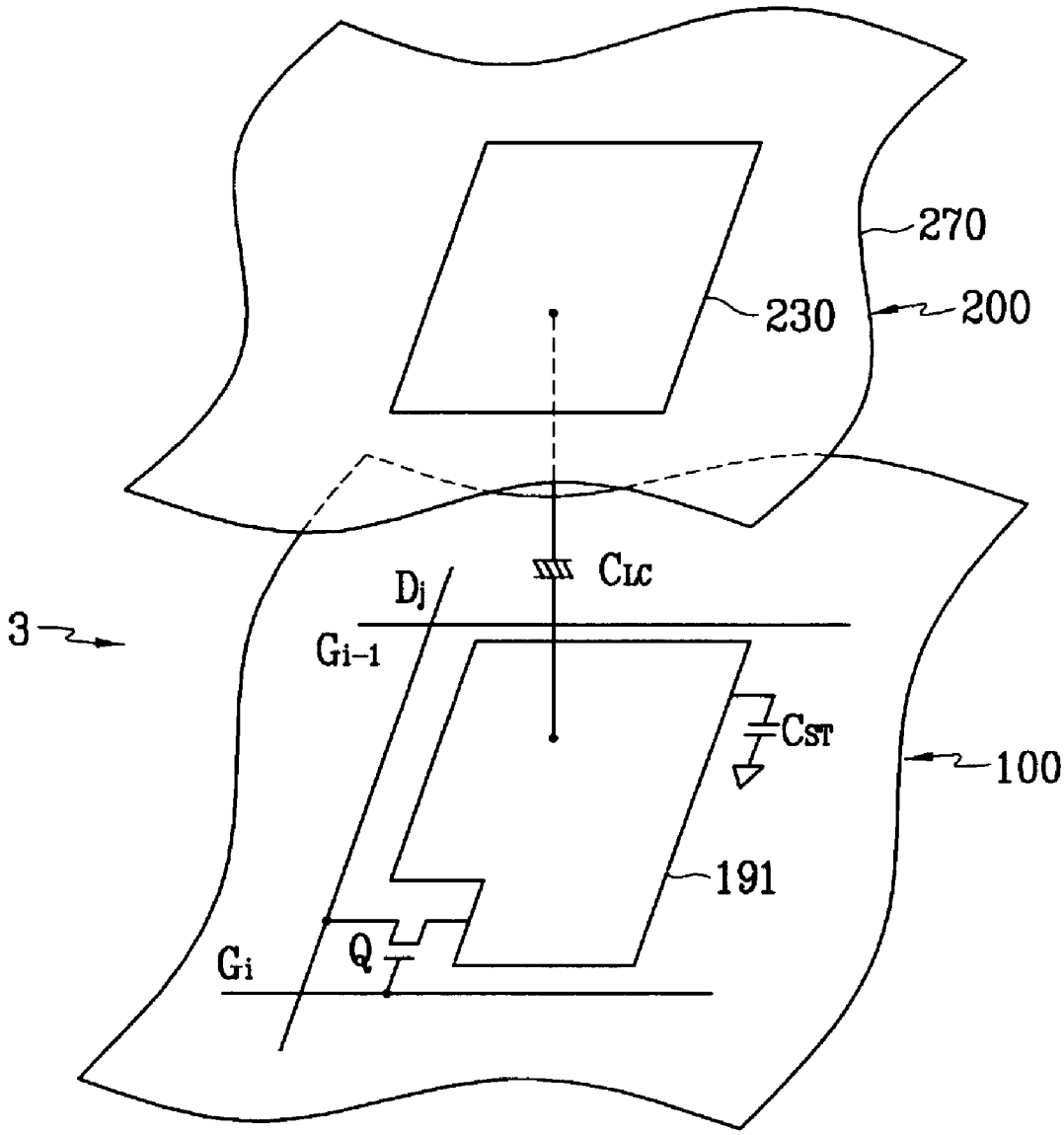
FIG. 2 is an equivalent circuit diagram of a pixel of an LCD according to an embodiment of the present invention.

In order to express colors, respective pixels PX may be dedicated to each of the primary colors (spatial division), or alternately may express the primary colors in a temporal order (time division) such that the spatial or temporal sum of the primary colors may be perceived as the desired color image. The primary colors may include red, green, and blue colors. FIG. 2 illustrates an example of the spatial division, in which each pixel PX has a color filter 230 expressing one of the primary colors at the region of the upper panel 200 corresponding to pixel electrode 191. Different from the structure shown in FIG. 2, the color filter 230 may be formed on or under pixel electrode 191 of the lower panel 100. At least one polarizer (not shown) is attached to the outer surface of the liquid crystal panel assembly 300 to polarize light.

Referring to FIG. 1 again, the gray voltage generator 800 generates two sets of gray voltages (hereinafter called the reference gray voltage sets) related to the light transmittance of pixels PX. One of the two gray voltage sets has a positive value with respect to the common voltage Vcom, and the other has a negative value.

Gate driver 400 is connected to gate lines G1-Gn of the liquid crystal panel assembly 300 to apply gate signals based on the combinations of gate-on and gate-off voltages Von and Voff.

Data driver 500 is connected to data lines D1-Dm of the liquid crystal panel assembly 300 to select the gray voltages from the gray voltage generator 800, and apply them to data lines D1-Dm as data signals. However, if the gray voltage generator 800 provides only a predetermined number of the reference gray voltages, data driver 500 divides the reference gray voltages to generate gray voltages with respect to all the gray values, and selects data signals from those gray voltages. Signal controller 600 controls gate driver 400 and data driver 500.

The respective drivers 400, 500, 600, and 800 may be directly mounted on the liquid crystal panel assembly 300 in the form of one or more integrated circuit chips, or may be mounted on a flexible printed circuit film (not shown), and attached to the liquid crystal panel assembly 300 in the form of a tape carrier package (TCP). Alternatively, the drivers may be mounted on a separate printed circuit board (not shown). Furthermore, drivers 400, 500, 600, and 800 may be integrated on liquid crystal panel assembly 300 together with signal lines G1-Gn and D1-Dm and thin film transistor switching elements Q. Furthermore, drivers 400, 500, 600, and 800 may be integrated in the form of a single chip, and in this case, one of those drivers or one of the circuit elements for the drivers may be placed external to the single chip.

The operation of the LCD will now be explained in detail. Signal controller 600 receives input image signals R, G, and B, and input control signals from an external graphics controller (not shown). Input image signals R, G, and B contain luminance information for a predetermined numbers of gray levels, such as 1024 ($=2^{10}$), 256 ($=2^{8}$), or 64 ($=2^{6}$). The input control signals include vertical synchronization signals Vsync, horizontal synchronization signals Hsync, main clock signals MCLK, and data enable signals DE.

Signal controller 600 suitably processes the input image signals R, G, and B based on the input image signals R, G, and B and the input control signals. Signal controller 600 generates gate control signals CONT1 and data control signals CONT2 to output gate control signals CONT1 to gate driver 400, and data control signals CONT2 and the processed image signal DAT to data driver 500. The output image signals DAT have predetermined numbers of values (or gray levels) as digital signals.

Gate control signals CONT1 include scanning start signals STV and at least one clock signal for controlling the output cycle of the gate-on voltage Von. The gate control signals CONT1 may further include output enable signals OE for defining the duration time of the gate-on voltage Von.

Data control signals CONT2 include horizontal synchronization start signals STH for informing of the starting of the image data transmission, load signals LOAD for applying data signals to data lines D1-Dm, and data clock signals HCLK. Data control signals CONT2 may further include reverse signals RVS for inverting the voltage polarity of data signals with respect to the common voltage Vcom (referred to hereinafter as the "polarity of data signal").

Data driver 500 receives digital image signals DAT for a row of pixels PX in accordance with data control signals CONT2 from the signal controller 600, and selects the gray voltages corresponding to the respective digital image signals DAT, followed by converting the digital image signals DAT into analog data signals and applying them to the relevant data lines D1-Dm.

Gate driver 400 applies the gate-on voltage Von to gate lines G1-Gn in accordance with gate control signals CONT1 from the signal controller 600 to turn on the switching elements Q connected to gate lines G1-Gn. Then, the data signals applied to data lines D1-Dm are applied to the relevant pixels PX through the turned on switching elements Q.

The difference between the data signal voltage applied to pixel PX and the common voltage Vcom is expressed by the charge voltage of the liquid crystal capacitor $C_{LC}$, that is, by the pixel voltage. The alignments of the liquid crystal molecules differ depending upon the amplitude of the pixel voltage which, in turn, varies the polarization of the light passing the liquid crystal layer 3. The polarization variation varies the light transmittance based on the polarizer attached to the liquid crystal panel assembly 300. In this way, pixels PX express the luminance represented by the gray levels of image signals DAT.

This process is repeated for a horizontal cycle (indicated as "1H" and that is the same as one cycle of the horizontal synchronization signal Hsync and the data enable signal DE) as a unit, and consequently, gate-on voltages Von are sequentially applied to all gate lines G1-Gn to apply data signals to all pixels PX, thereby displaying a one-frame images.

As one frame is terminated, the next frame starts. The reverse signals RVS applied to data driver 500 are controlled such that the polarity of the data signal applied to each pixel PX is opposite to the polarity thereof in the previous frame (the "frame inversion"). Even within one frame, it is possible that the polarities of the data signals flowing along one data line are inverted depending upon the characteristic of the reverse signals RVS (for example, with a row inversion or a dot inversion), or that the polarities of the data signals applied to a row of pixels are different from each other (for example, with a column inversion or a dot inversion).

When voltages are applied to both ends of the liquid crystal capacitor $C_{LC}$, the alignment of the liquid crystal molecules require some finite time to become realigned corresponding to the applied voltages. When the voltage applied to liquid crystal capacitor $C_{LC}$ is sustained, the liquid crystal molecules continuously move up to the stabilized state, continuously varying the amount of light transmitted. When the liquid crystal molecules are stabilized, the light transmittance becomes constant.

When the stabilized pixel voltage is referred to as the target pixel voltage and the light transmittance at that state as the target light transmittance, the target pixel voltage and the target light transmittance are in one to one correspondence with each other.

However, as the time for turning on the switching element Q of each pixel Px and applying a data voltage thereto is limited, it is difficult for the liquid crystal molecules to reach a stable state during the application of the data voltage. Even if the switching element Q turns off, the voltage difference between both ends of the liquid crystal capacitor $C_{LC}$ remains and, accordingly, the liquid crystal molecules continuously move up to the stabilized state. When the alignment of the liquid crystal molecules is varied, the dielectric constant of the liquid crystal layer 3 is changed, and accordingly the static capacity of the liquid crystal capacitor $C_{LC}$ is altered. With the turning off of the switching element Q, one terminal of liquid crystal capacitor $C_{LC}$ is in a floating state and, neglecting leakage current, the charge stored at liquid crystal capacitor $C_{LC}$ remains constant. Therefore, the variation in the static capacity of liquid crystal capacitor $C_{LC}$ causes a variation in voltage of the liquid crystal capacitor $C_{LC}$ and, in turn, a variation in pixel voltage.

When the data voltage corresponding to the target pixel voltage based on the stabilized pixel state (referred to hereinafter as the "target data voltage") is directly applied to pixel PX, the effective pixel voltage differs from the target pixel voltage, and accordingly it is difficult to obtain the target light transmittance. Particularly, the larger the difference between the target light transmittance and the initial light transmittance of the pixel is, the greater the difference between the effective pixel voltage and the target pixel voltage becomes.

Accordingly, it is required to make the data voltage applied to pixel PX higher or lower than the target data voltage, for instance, by way of a dynamic capacitance compensation (DCC).

In this embodiment, the DCC is conducted at the signal controller 600 or a separate image signal modifier. With the DCC, the one-frame image signal for a pixel PX (referred to hereinafter as the "current image signal $g_N$") is modified based on the just previous frame image signal for pixel PX (referred to hereinafter as the "previous image signal $g_{N-1}$") to make a modified current image signal (referred to hereinafter as the "first modified image signal $g_{N'}$"). The first modified image signal $g_{N'}$ is basically determined by experiment results, and the difference between the first modified image signal $g_{N'}$ and the previous image signal $g_{N-1}$ is roughly greater than the difference between the current image signal $g_N$ and the previous image signal $g_{N-1}$ before the modification. However, when the difference between the current image signal $g_N$ and the previous image signal $g_{N-1}$ is zero or close to zero, the first modified image signal $g_{N'}$ may be the same as the current image signal $g_N$ (that is, it may not be modified).

The first modified image signal $g_{N'}$ may be expressed by the following Formula 1:

$$g_{N'}=F1(g_N, g_{N-1}) \quad (1)$$

Consequently, the data voltage applied to each pixel PX from data driver 500 may be higher or lower than the target data voltage. Table 1 lists examples of the first modified image signal $g_{N'}$ with respect to several pairs of previous and current image signals $g_{N-1}$ and $g_N$ in the case that the number of gray levels is 256. In order to conduct the image signal modification, it is necessary to provide a frame memory for storing the previous-framed image signal $g_{N-1}$ and a lookup table for storing the relationship of Table 1.

The dimension of the lookup table should be significantly large so as to store the first modified image signals $g_{N'}$ with respect to all the pairs of previous and current image signals $g_{N-1}$ and $g_N$. In this connection, it is preferable that the first modified image signals $g_N$ only for the previous and the current image signal pairs $g_{N-1}$ and $g_N$ as with Table 1 are stored as the reference modified image signals, and the first modified image signals for the remaining previous and current image signal pairs $g_{N-1}$ and $g_N$ are obtained through interpolation. With the interpolation of a pair of previous and current image signals $g_{N-1}$ and $g_N$, the reference modified image signals for the image signal paires $g_{N-1}$ and $g_N$ that are close to the relevant image signal pair $g_{N-1}$ and $g_N$ are found in Table 1, and the first modified image signals $g_{N'}$ for the relevant image signal pair $g_{N-1}$ and $g_N$ obtained based on the found values.

TABLE 1

| | $g_{N-1}$ | | | | | | | | |
|---|---|---|---|---|---|---|---|---|---|
| $g_N$ | 0 | 32 | 64 | 96 | 128 | 160 | 192 | 224 | 255 |
| 0 | 0 | 0 | 0 | 0 | 0 | 0 | 0 | 0 | 0 |
| 32 | 115 | 32 | 22 | 20 | 15 | 15 | 15 | 15 | 15 |
| 64 | 169 | 103 | 64 | 50 | 34 | 27 | 22 | 20 | 16 |
| 96 | 192 | 146 | 118 | 96 | 87 | 70 | 54 | 36 | 29 |
| 128 | 213 | 167 | 156 | 143 | 128 | 121 | 105 | 91 | 70 |
| 160 | 230 | 197 | 184 | 179 | 174 | 160 | 157 | 147 | 129 |
| 192 | 238 | 221 | 214 | 211 | 205 | 199 | 192 | 187 | 182 |
| 224 | 250 | 245 | 241 | 240 | 238 | 238 | 224 | 224 | 222 |
| 255 | 255 | 255 | 255 | 255 | 255 | 255 | 255 | 255 | 255 |

For instance, the digitalized image signals are divided into upper and lower bits, and the reference modified image signals $g_{N'}$ for the pairs of previous and current image signals $g_{N-1}$ and $g_N$ with the lower bit of 0 are stored at the lookup table. The relevant reference modified image signals $g_{N'}$ pairs of previous and current image signals $g_{N-1}$ and $g_N$ are found from the lookup table based on the upper bits thereof, and modified image signals are produced using the lower bits of the previous and the current image signals and the reference modified image signal $g_{N'}$ found from the lookup table.

However, it is difficult to obtain the target light transmittance even in such a way, and in this case, a so-called pre-tilt may be caused such that the liquid crystal molecules are pre-tilted by previously applying medium-sized voltages thereto in the previous frame, and again applying voltages in the current frame.

For this purpose, when the current-framed image signal $g_N$ is modified, the signal controller 600 or the image signal modifier considers the previous frame image signal $g_{N-1}$ as well as the next frame image signal $g_{N+1}$ (referred to hereinafter as the "next image signal"). For instance, in a case that the current image signal $g_N$ is the same as the previous image signal $g_{N-1}$ but the next image signal $g_{N+1}$ is largely different from the current image signal $g_N$, the current image signal $g_N$ is modified to cope with the next frame.

In this case, the first modified image signal $g_{N'}$ may be expressed by the following Formula 2, and it is required to provide a frame memory for storing the previous and current image signals $g_{N-1}$ and $g_N$ and a lookup table for storing the modified image signals for the pairs of previous and current image signals $g_{N-1}$ and $g_N$. Occasionally, it may be necessary to provide a lookup table for storing the modified image signals for the pairs of current and next image signals $g_N$ and $g_{N+1}$.

$$g_{N'}=F2(g_{N+1}, g_N, g_{N-1}) \quad (2)$$

The modification of the image signal and the data voltage may or may not be conducted with respect to the maximum gray level or the minimum gray level among the gray levels expressed by the image signals. In order to modify the maximum gray level or the minimum gray level, the range of the gray voltages generated by the gray voltage generator 800 may be established to be wider than the range of the target data voltages required for obtaining the target luminance range (or the target light transmittance range) indicated by the gray levels of the image signals.

With the embodiment of the present invention, as indicated by the following Formula 3, the difference between the first modified image signal $g_{N'}$ and the current image signal $g_N$ is multiplied by $\alpha$, and the multiplied value is added to the current image signal $g_N$, thereby producing a second modified image signal $g_{N''}$.

$$g_{N''}=g_N+\alpha\times(g_{N'}-g_N) \quad (3)$$

where $\alpha$ indicates the modification variable that is varied depending upon the respective pixels Px on the screen, and is obtained by analyzing a plurality of image signals within one frame. Specifically, the modification-variable a indicates the degree of gray variation in the image signals at a specific pixel with respect to the pixels neighboring thereto. When the gray variation degree is high, the modification value a becomes large, but when the gray variation degree is low, the modification value $\alpha$ becomes small. It is preferable that the modification value a is in the range of 1 to 3. The modification value $\alpha$ is a parameter representing the boundary or edge of an object, and may be computed in various manners. That is, the pixel where the modification value $\alpha$ is large represents the boundary of the object, and the pixel where the modification value is small represents the surface of the object.

As indicated by Formula 3, the second modified image signal $g_{N''}$ for the pixel where the gray variation thereof with respect to the pixels neighboring thereto is high is greater than the first modified image signal $g_{N'}$, while the second modified image signal $g_{N''}$ for the pixel where the gray variation thereof with respect to the pixels neighboring thereto is low is nearly the same as the first modified image signal gN'. In this way, when the image signals are compensated such that the light transmittance at the pixel where the gray variation thereof with respect to the pixels neighboring thereto is high is higher than the target light transmittance, the boundary of the object becomes clear, thereby decreasing the blurring.

When the gray variation at a pixel with respect to the neighboring pixels is low are compensated to bear a light transmittance that is higher than the target light transmittance, the display image quality is liable to be deteriorated. For instance, reversed images may be displayed at the place where the object is shifted. With the embodiment of the present invention, the image signals are selectively over-compensated only at the boundary area, and the normal DCC is made for the image signals at the remaining area, thereby preventing the display image quality from being deteriorated.

In sum, the normal DCC is made for the pixels where the gray variation thereof with respect to the pixels neighboring thereto is low, and the over-compensation is made for the pixels where the gray variation thereof with respect to the pixels neighboring thereto is high, thereby preventing the moving images from being blurred and from being deteriorated.

Figure 3:
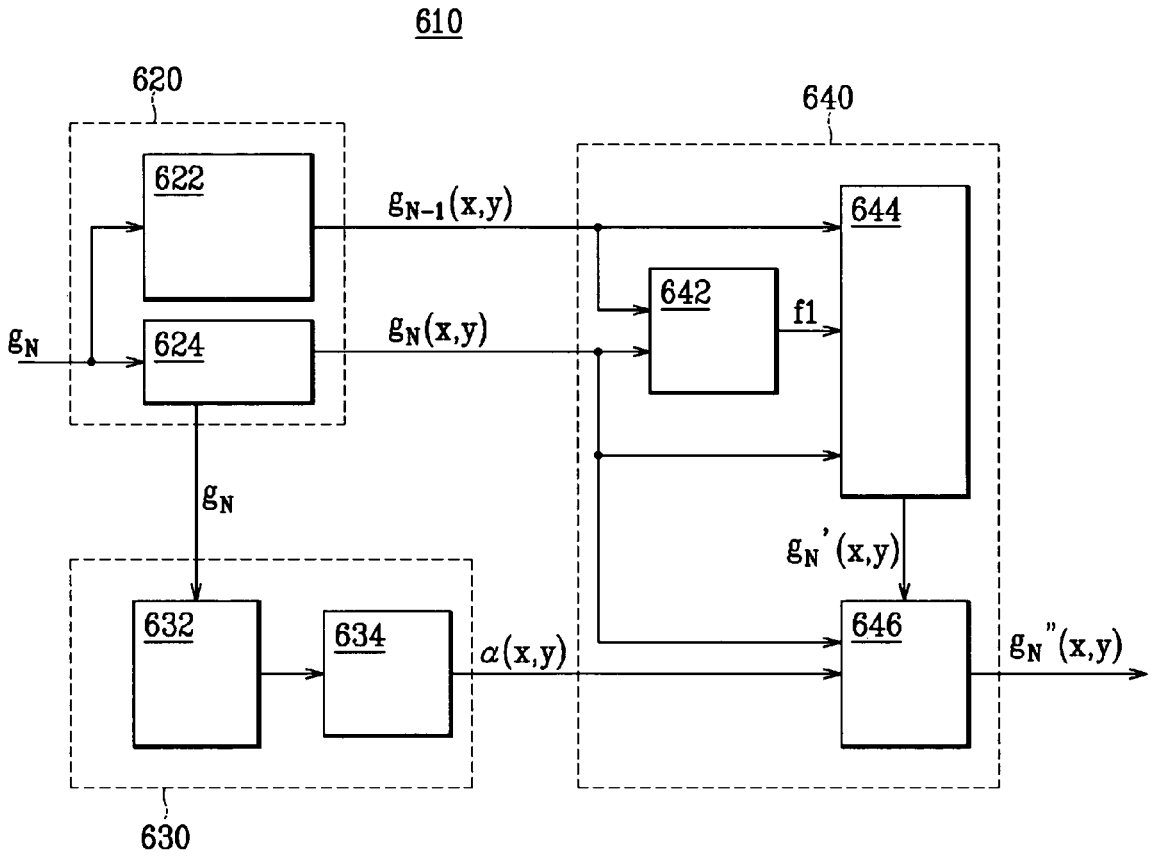
FIG. 3 is a block diagram of an image signal modifier according to an embodiment of the present invention.
Figure 4:
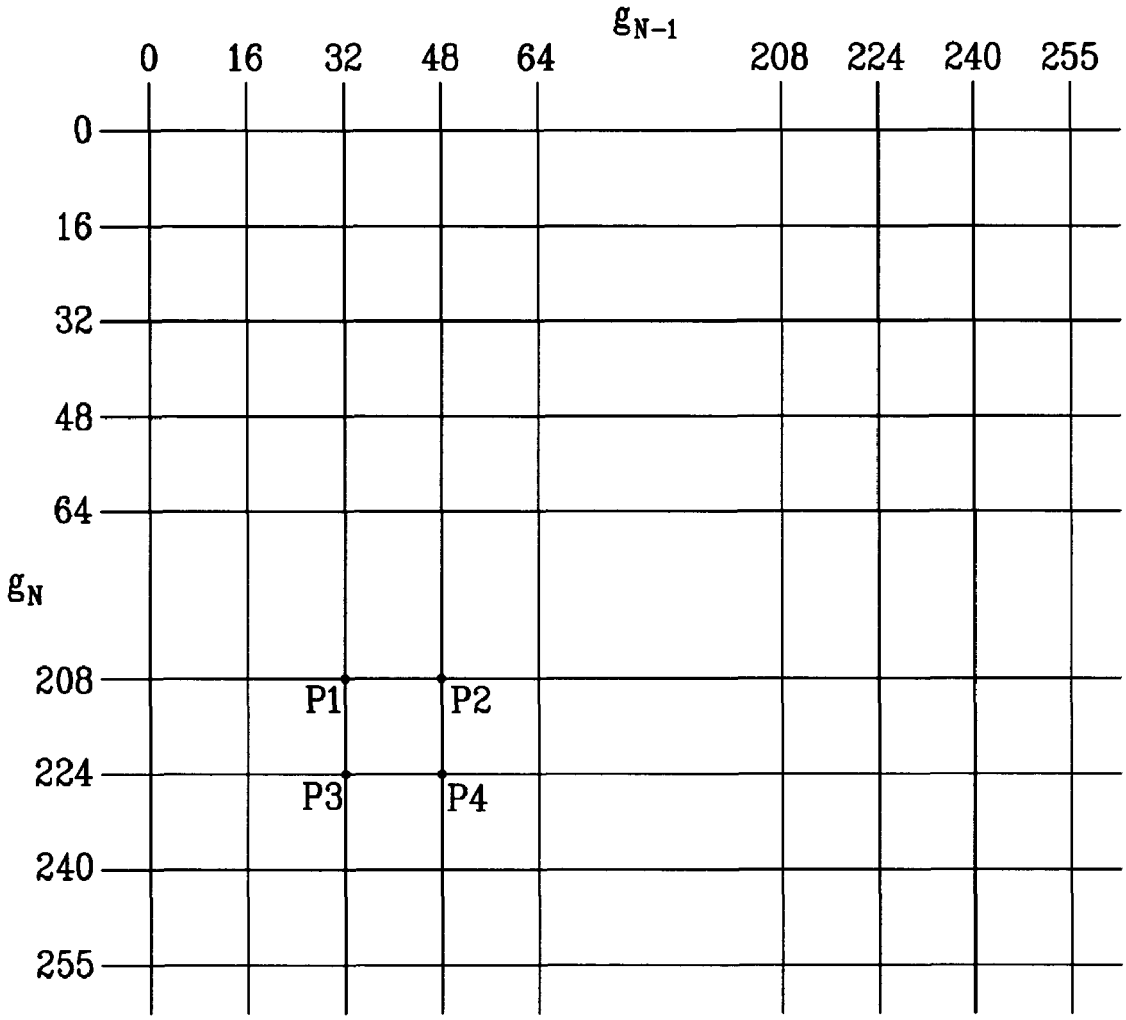
FIG. 4 schematically illustrates a way of modifying image signals according to an embodiment of the present invention.
Figure 5:
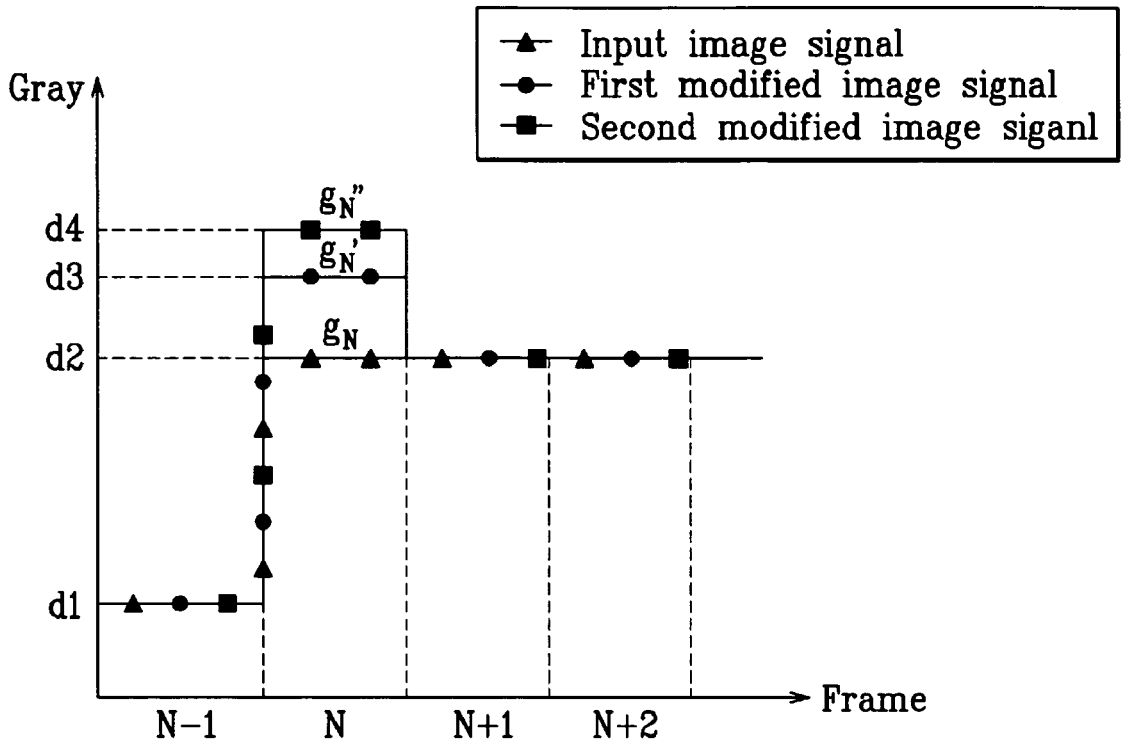
FIG. 5 illustrates input image signals and modified image signals according to an embodiment of the present invention.

An image signal modifier of an LCD according to an embodiment of the present invention will be now explained specifically with reference to FIGS. 3 to 5. FIG. 3 is a block diagram of an image signal modifier of an LCD according to an embodiment of the present invention, and FIG. 4 schematically illustrates a way of modifying image signals according to an embodiment of the present invention. FIG. 5 illustrates input image signals and modified image signals according to an embodiment of the present invention.

As shown in FIG. 3, an image signal modifier 610 according to an embodiment of the present invention includes a memory 620 connected to the current image signal gN, a modification variable operator 630 connected to the memory 620, and an operation processor 640 connected thereto. The image signal modifier 610 or the operation processor 640 may belong to the signal controller 600 shown in FIG. 1, or may be provided separately. The memory 620 includes a frame memory 622 and a line memory 624, and it stores the previous and current image signals $g_{N-1}$ and $g_N$.

The frame memory 622 supplies the previous image signal $g_{N-1}(x, y)$ of the yth pixel at the xth pixel row (referred to hereinafter as the "(x, y) pixel") among the stored previous image signals $g_{N-1}$ to the operation processor 640, and stores the input current image signals $g_N$.

The line memory 624 stores multiple rows of image signals among the input current image signals $g_N$, and supplies them to the modification variable operator 630. The line memory 624 supplies the current image signal $g_N(x, y)$ of the (x, y) pixel to the operation processor 640.

The modification variable operator 630 includes a detector 632 and a scale controller 634, and produces a modification variable $\alpha(x, y)$ with respect to the (x, y) pixel based on the current image signal $g_N(x, y)$ of the (x, y) pixel and the current image signals $g_N$ of the pixels neighboring thereto.

The detector 632 receives the images signals of the (x, y) pixel and the pixels neighboring thereto among the current image signals gN from the line memory 624, and computes the gray variation degree of the (x, y) pixel with respect to the pixels neighboring thereto to output the computed value to the scale controller 634. The detector 632 includes a high pass filter or an edge detection unit for computing the gray variation degree. The neighboring pixels refer to the same-colored pixels placed around the (x, y) pixel up and down and left and right, and the number of neighboring pixels referred to in the operation is varied depending upon the high pass filter or the edge detection unit. The edge detection unit may use Roberts, Prewitt, Sobel, or Frei-Chen operators as the first differential, and Laplacian operators as the second differential.

The scale controller 634 receives information about the gray variation degree from the detector 632, and converts it into a modification variable $\alpha(x, y)$ with a value of 1 to 3. The modification variable $\alpha(x, y)$ is large where the gray variation degree is high, while it is small where the gray variation degree is low. The scale controller 634 outputs the produced modification variable $\alpha(x, y)$ to the operation processor 640.

The operation processor 640 includes a lookup table 642 and first and second modification units 644 and 646, and generates a second modified image signal $g_{N''}(x, y)$ based on the previous image signal $g_{N-1}(x, y)$, the current image signal $g_N(x, y)$, and the modification variable $\alpha(x, y)$.

The lookup table 642 stores the reference modified image signals f1 for the previous and current image signals $g_{N-1}$ and $g_N$, and outputs a plurality of reference modified image signals f1 corresponding to the relevant pairs of previous and current image signals $g_{N-1}(x, y)$ and $g_N(x, y)$.

The first modification unit 644 generates a first modified image signal $g_{N'}(x, y)$ by interpolating the reference modified image signal f1 from the lookup table 642 and the previous and current image signals $g_{N-1}(x, y)$ and $g_N(x, y)$ from the memory 620.

For instance, as shown in FIG. 4, assume that the image signals are 8 bits and 256 gray levels, and the reference modified image signals f1 for the combinations of the previous and current image signals $g_{N-1}$ and $g_N$ of 17×17 per the units of 16 gray levels are stored at the lookup table 642. In case the input pair of previous and current image signals $g_{N-1}$ and $g_N$ is (36, 218), the first modification unit 644 receives the reference modified image signals P1, P2, P3, and P4 for the respective pairs of previous and current image signals (32, 208), (48, 208), (32, 224), and (48, 224) from the lookup table 642, and linearly interpolates based thereon to thereby produce the first modified image signals $g_{N'}$. The reference modified image signals f1 are previously determined through experiments.

The second modification unit 646 receives the first modified image signal $g_{N'}(x, y)$ for the (x, y) pixel from the first modification unit 644, the current image signal $g_N(x, y)$ from the line memory 624, and the modification variable $\alpha(x, y)$ from the scale controller 634, and conducts the operation of Formula 3 to thereby produce a second modified image signal $g_{N''}(x, y)$.

For instance, as shown in FIG. 5, when the gray value of the previous image signal $g_{N-1}$ is d1 and the gray value of the current image signal $g_N$ is d2 (>d1), the gray value d3 of the first modified image signal $g_{N'}$ is more than the value of d2. The gray value d4 of the second modified image signal $g_{N''}$ is obtained by d4=d2+α×(d3−d2). The modification variable α for the relevant pixel is 1 or more, and the value of d4 is more than the value of d3. The higher the modification value α is, the more the value of d4 is heightened such that it is significantly higher than the normal DCC value d3. The gray value of the next image signal $g_{N+1}$ is d2, which is the same as the gray value d2 of the current image signal $g_N$. Accordingly, the gray value of the first and second modified image signals $g_{N+1'}$ and $g_{N+1''}$ of the next frame N+1 becomes d2.

Figure 6:
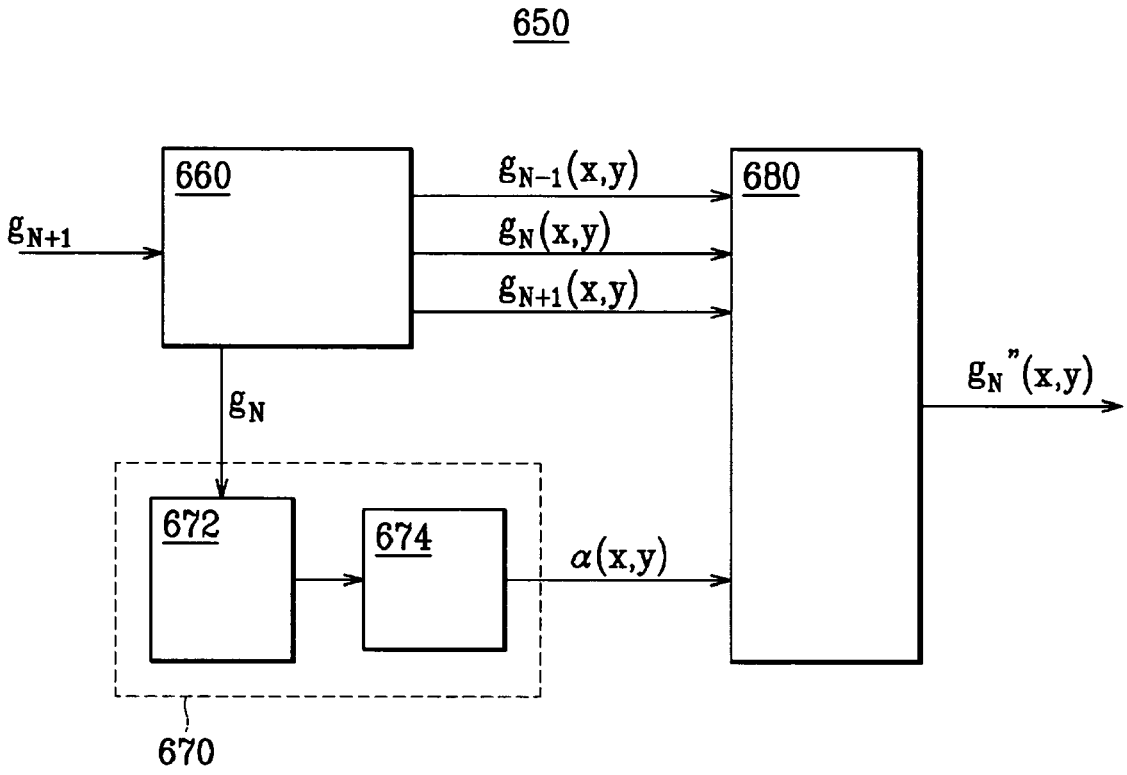
FIG. 6 is a block diagram of an image signal modifier of an LCD according to another embodiment of the present invention.
Figure 7:
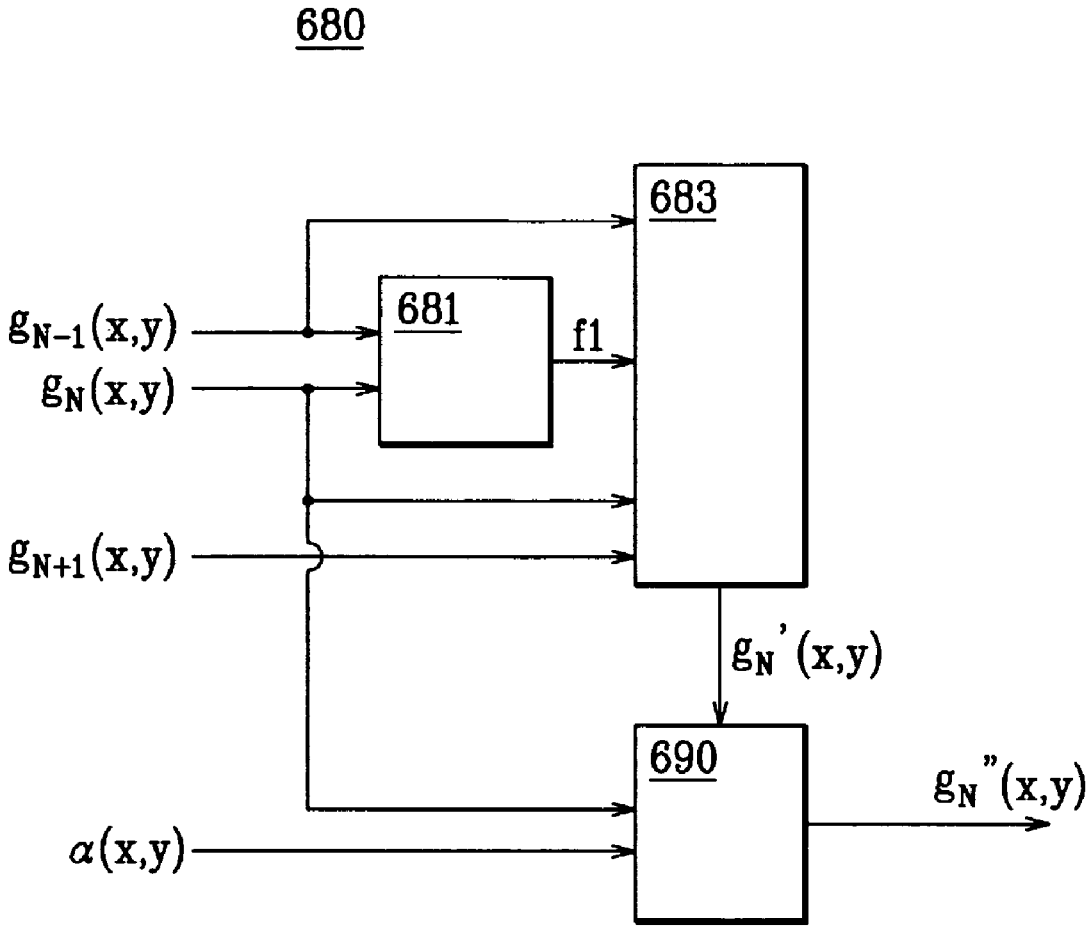
FIG. 7 is a block diagram of an example of the operation processor shown in FIG. 6.
Figure 8:
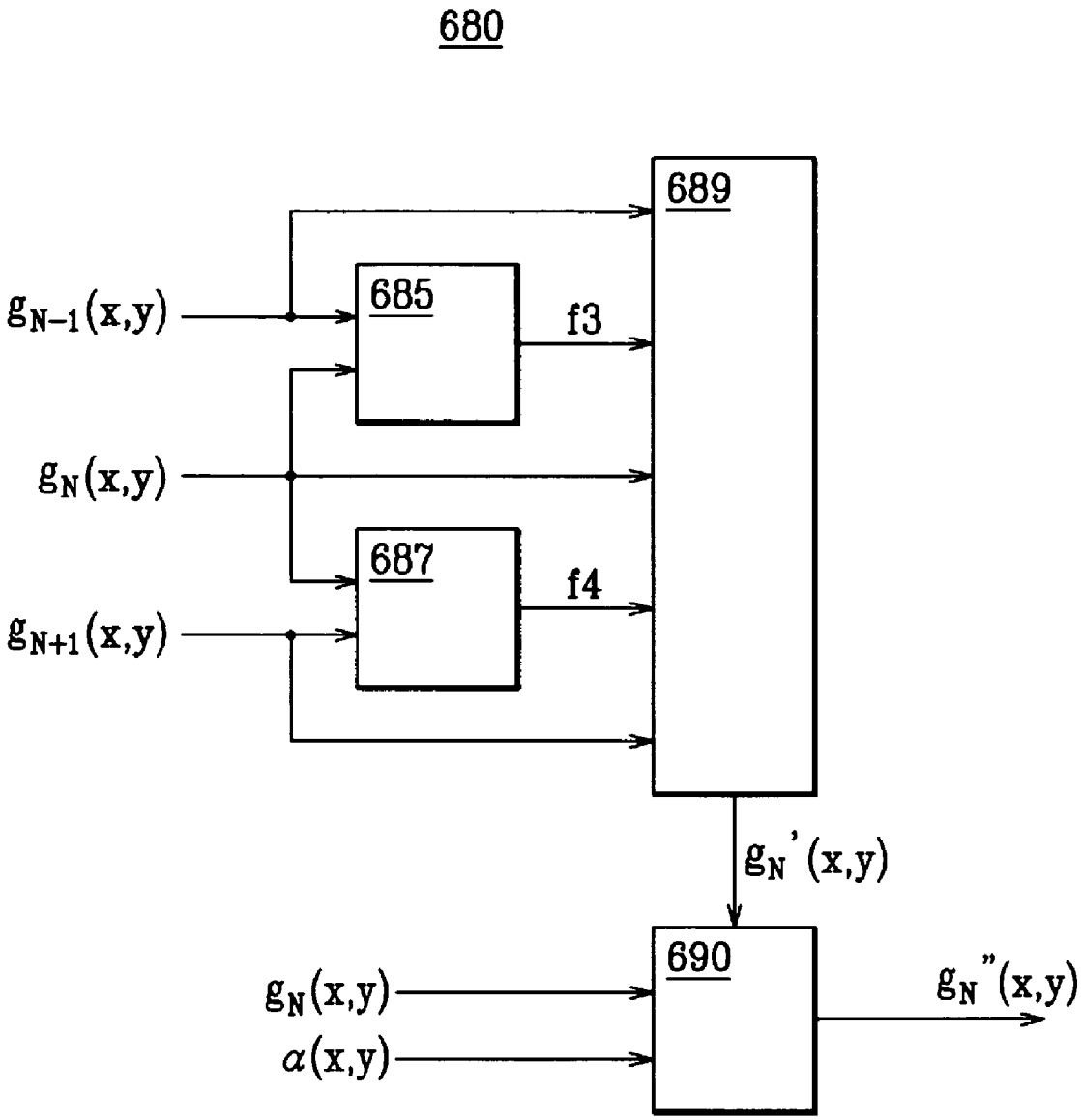
FIG. 8 is a block diagram of another example of the operation processor shown in FIG. 6.

An image signal modifier of an LCD according to another embodiment of the present invention will now be specifically explained with reference to FIGS. 6 to 8. FIG. 6 is a block diagram of an image signal modifier of an LCD according to another embodiment of the present invention, and FIG. 7 is a block diagram of an example of the operation processor shown in FIG. 6. FIG. 8 is a block diagram of another example of the operation processor shown in FIG. 6.

As shown in FIG. 6, an image signal modifier 650 according to another embodiment of the present invention includes a memory 660 connected to the next image signal $g_{N+1}$, a modification variable operator 670 connected to the memory 660, and an operation processor 680 connected thereto.

The memory 660 includes at least one frame memory (not shown) and a plurality of line memories (not shown), and stores previous image signals $g_{N-1}$, current image signals $g_N$, and next image signals $g_{N+1}$. The frame memory supplies the stored previous and current image signals $g_{N-1}(x, y)$ and $g_N(x, y)$ to the operation processor 680, and stores the input next image signals $g_{N+1}$. A plurality of frame memories or a frame memory may store image signals $g_{N-1}$, $g_N$ and $g_{N+1}$.

The line memory stores a plurality of rows of image signals among the current image signals $g_N$ from the frame memory, and supplies them to the modification variable operator 670. The line memory supplies the current image signal $g_N(x, y)$ of the (x, y) pixel to the operation processor 680.

The modification variable operator 670 includes a detector 672 and a scale controller 674, and produces a modification variable $\alpha(x, y)$ for the (x, y) pixel based on the current image signal $g_N(x, y)$ of the (x, y) pixel and the current image signals $g_N$ of the pixels neighboring thereto, and sends it to the operation processor 680. The modification variable operator 670 is substantially the same as the modification variable operator 630 related to the previous embodiment, and hence a detailed explanation thereof will be omitted.

The operation processor 680 shown in FIG. 7 will be explained first. The operation processor 680 includes a lookup table 681 and first and second modification units 683 and 690, and generates a second modified image signal $g_{N''}(x, y)$ based on the previous image signal $g_{N-1}(x, y)$, the current image signal $g_N(x, y)$, the next image signal $g_{N+1}(x, y)$, and the modification variable $\alpha(x, y)$.

The lookup table 681 stores the reference modified image signals f2 for the previous and the current image signals $g_{N-1}$ and $g_N$, and sends a plurality of reference modified image signals f2 corresponding to the relevant pairs of previous and-current image signals $g_{N-1}(x, y)$ and $g_N(x, y)$ to the first modification unit 683.

The first modification unit 683 generates first modified image signals $g_{N'}(x, y)$ by operation-processing the reference modified image signals f2 from the lookup table 681, and the previous, current, and next image signals $g_{N-1}(x, y)$, $g_N(x, y)$, and $g_{N+1}(x, y)$ from the memory 660.

For instance, the operation processing may be performed in the following way. As with the previous embodiment, the interpolation is done with the previous and current image signals $g_{N-1}(x, y)$ and $g_N(x, y)$ and the reference modified image signals f2 to primarily produce preliminary modified signals. If the preliminary modified signal is smaller than a first set point and the next image signal $g_{N+1}(x, y)$ is greater than a second set point, a first modified image signal is obtained by adding a third set point to the preliminary modified image signal. Otherwise, the first modified image signal $g_{N'}(x, y)$ has the same value as the preliminary modified signal. However, the operation processing is not limited thereto, and the first modified image signal $g_{N'}(x, y)$ may be produced in various ways.

The second modification unit 690 receives the first modified image signal $g_{N'}(x, y)$ for the (x, y) pixel from the first modification unit 683, the current image signal $g_N(x, y)$ from the line memory 660, and the modification variable $\alpha(x, y)$ from the scale controller 674, and conducts the operation of Formula 3, thereby producing a second modified image signal $g_{N''}(x, y)$.

The operation processor 680 shown in FIG. 8 will be now explained. The operation processor 680 includes first and second lookup tables 685 and 687 and first and second modification units 689 and 690, and generates a second modified image signal $g_{N''}(x, y)$ for the (x, y) pixel based on the previous image signal $g_{N-1}(x, y)$, the current image signal $g_N(x, y)$, the next image signal $g_{N+1}(x, y)$, and the modification variable $\alpha(x, y)$.

The first lookup table 685 stores the reference modified image signals f3 for the previous and current image signals $g_{N-1}$ and $g_N$, and outputs a plurality of reference modified image signals f3 corresponding to the relevant pairs of previous and current image signals $g_{N-1}(x, y)$ and $g_N(x, y)$ to the first modification unit 689.

The second lookup table 687 stores the reference modified image signals f4 for the current and next image signals $g_N$ and $g_{N+1}$, and outputs a plurality of reference modified image signals f4 corresponding to the relevant pairs of current and next image signals $g_N(x, y)$ and $g_{N+1}(x, y)$ to the first modification unit 689.

The first modification unit 689 generates first modified image signals $g_{N'}(x, y)$ by operation-processing the reference modified image signals f3 and f4 from the first and second lookup tables 685 and 687, and the previous, current, and next image signals $g_{N-1}(x, y)$, $g_N(x, y)$, and $g_{N-1}(x, y)$ from the memory 660.

For instance, three cases may be made to generate the first modified image signals $g_{N'}(x, y)$ depending upon the previous, current, and next image signals $g_{N-1}(x, y)$, $g_N(x, y)$, and $g_{N+1}(x, y)$.

First, in the case that the difference between the previous and current image signals $g_{N-1}(x, y)$ and $g_N(x, y)$ does not exceed a fourth set point while the difference between the current and next image signals $g_N(x, y)$ and $g_{N+1}(x, y)$ exceeds a fifth set point, the interpolation is made with the current and next image signals $g_N(x, y)$ and $g_{N+1}(x, y)$ and the reference modified image signals f4, thereby producing first modified image signals $g_{N'}(x, y)$.

Second, in the case that the difference between the previous and current image signals $g_{N-1}(x, y)$ and $g_N(x, y)$ exceeds the fourth set point, the interpolation is made with the previous and current image signals $g_{N-1}(x, y)$ and $g_N(x, y)$ and the reference modified image signals f3, thereby producing first modified image signals $g_{N'}(x, y)$.

Third, in the case that the difference between the previous and current image signals $g_{N-1}(x, y)$ and $g_N(x, y)$ does not exceed the fourth set point while the difference between the current and next image signals $g_N(x, y)$ and $g_{N+1}(x, y)$ does not exceed the fifth set point, the first modified image signal $g_{N'}(x, y)$ has the same value as the current image signal $g_N(x, y)$ However, the operation processing is not limited thereto, and the first modified image signals $g_{N'}(x, y)$ may be produced by further increasing the number of cases and operation ways.

The second modification unit 690 receives the first modified image signal $g_{N'}(x, y)$ for the (x, y) pixel from the first modification unit 689, the current image signal $g_N(x, y)$ from the memory 660, and the modification variable $\alpha(x, y)$ from the scale controller 674, and conducts the operation of Formula 3 to thereby produce a second modified image signal $g_{N''}(X, y)$.

The structure according to the embodiment of the present invention is explained in relation to an LCD, but it may be applied to other display devices where the blurring may occur.

As described above, the DCC is made for the pixel where the gray variation thereof with respect to the pixels neighboring thereto is low to obtain the target luminance within one frame, and the over-compensation that is greater than the DCC is made for the pixel where the gray variation thereof with respect to the neighboring pixels is high to obtain a luminance higher than the target luminance, thereby decreasing the blurring at the boundary area of the moving image and preventing the deterioration in the display image such as an occurrence of a reversed image due to the movement of the object.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A display device comprising:

a plurality of pixels having first and second pixels; and an image signal modifier for generating a modified image signal by modifying the input image signal of the first pixel based on the previous image signal of the first pixel and the input image signal of the second pixel, wherein the image signal modifier comprises a modification variable operator for producing a modification variable representing the degree of gray variation in the input image signal of the first pixel with respect to the input image signal of the second pixel.

2. The display device of claim 1, wherein the modification variable operator comprises a high pass filter or an edge detection unit.

3. The display device of claim 1, wherein the modification variable has a predetermined range of values, and with a minimum gray variation, the modification variable has the minimum value, while with a maximum gray variation, the modification variable has the maximum value.

4. The display device of claim 1, wherein the modification variable has a value range of 1 to 3.

5. The display device of claim 1, wherein the modification variable operator produces the modification variable further based on the input image signal of a third pixel neighboring to the first pixel to express the same color as the color of the first pixel.

6. The display device of claim 1, wherein the image signal modifier further comprises a first modification unit for generating a preliminary modified signal by modifying the input image signal of the first pixel based on the previous image signal of the first pixel, and the difference between the preliminary modified signal and the previous image signal of the first pixel is more than the difference between the input image signal of the first pixel and the previous image signal of the first pixel.

7. The display device of claim 6, wherein the image signal modifier further comprises a lookup table for memorizing the preliminary modified signal with respect to the pair of previous and input image signals of the first pixel.

8. The display device of claim 6, wherein the image signal modifier further comprises a second modification unit for producing the modified image signal by subtracting the input image signal of the first pixel from the preliminary modified signal from the first modification unit, multiplying the subtracted value by the modification variable, and adding the input image signal of the first pixel to the multiplied value.

9. The display device of claim 1, wherein the image signal modifier further comprises a frame memory for storing the previous image signal of the first pixel and the input image signal of the first pixel, and the input image signal of the second pixel.

10. The display device of claim 1, wherein the image signal modifier further comprises a line memory for storing the input image signals of the first and second pixels.

11. The display device of claim 1, further comprising a data driver for converting the modified image signal into a data voltage, and applying the data voltage to the first pixel.

12. The display device of claim 1, wherein the second pixel neighbors the first pixel to express the same color as the color of the first pixel.

13. A display device comprising:

a plurality of pixels having first and second pixels; and an image signal modifier for generating a modified image signal by modifying the input image signal of the first pixel based on the previous image signal of the first pixel, the next image signal of the first pixel, and the input image signal of the second pixel, wherein the image signal modifier comprises a modification variable operator for producing a modification variable representing the degree of gray variation in the input image signal of the first pixel with respect to the input image signal of the second pixel.

14. The display device of claim 13, wherein the image signal modifier further comprises a first modification unit for generating a preliminary modified signal by modifying the input image signal of the first pixel based on the previous image signal of the first pixel, and the next image signal of the first pixel.

15. The display device of claim 14, wherein the image signal modifier further comprises a first lookup table for storing the preliminary modified signal with respect to the pair of previous and input image signals of the first pixel.

16. The display device of claim 15, wherein the image signal modifier further comprises a second lookup table for storing the preliminary modified signal with respect to the pair of input and next image signals of the first pixel.

17. The display device of claim 14, wherein the image signal identifier further comprises a second modification unit for producing the modified image signal by subtracting the input image signal of the first pixel from the preliminary modified signal from the first modification unit, multiplying the subtracted value by the modification variable, and adding the input image signal of the first pixel to the multiplied value.

18. The display device of claim 13, wherein the image signal modifier comprises a frame memory for storing the previous image signal of the first pixel, the input image signal of the first pixel, the next image signal of the first pixel, and the input image signal of the second pixel.

19. A method of modifying an image signal with a display device having first and second pixels, the method comprising the steps of:

reading the previous image signal of the first pixel, the input image signal of the first pixel, and the input image signal of the second pixel; and modifying the input image signal of the first pixel based on the previous image signal of the first pixel and the input image signal of the second pixel wherein the modifying step comprises the sub-step of producing a modification variable representing the degree of gray variation in the input image signal of the first pixel with respect to the input image signal of the second pixel.

20. The method of claim 19, wherein the modification variable producing step comprises the sub-step of high-pass filtering or edge-detecting the input image signals of the first and the second pixels.

21. The method of claim 19, wherein the modifying step further comprises the sub-step of generating a preliminary modified signal based on the previous image signal of the first pixel and the input image signal of the first pixel, and the difference between the preliminary modified signal and the previous image signal of the first pixel is more than the difference between the input image signal of the first pixel and the previous image signal of the first pixel.

22. The method of claim 21, wherein the modifying step further comprises the sub-step of producing a modified image signal by subtracting the input image signal of the first pixel from the preliminary modified signal, multiplying the subtracted value by the modification variable, and adding the input image signal of the first pixel to the multiplied value.

23. A method of modifying an image signal with a display device having first and second pixels, the method comprising the steps of:

reading the previous image signal of the first pixel, the input image signal of the first pixel, the next image signal of the first pixel, and the input image signal of the second pixel; and modifying the input image signal of the first pixel based on the previous image signal of the first pixel, the next image signal of the first pixel, and the input image signal of the second pixel, wherein the modifying step comprises the sub-step of producing a modification variable representing the degree of gray variation in the input image signal of the first pixel with respect to the input image signal of the second pixel.

24. The method of claim 23, wherein the modifying step further comprises the sub-step of generating a preliminary modified signal based on the previous image signal of the first pixel, the input image signal of the first pixel, and the next image signal of the first pixel.

25. The method of claim 24, wherein the modifying step further comprises the sub-step of producing a modified image signal by subtracting the input image signal of the first pixel from the preliminary modified signal, multiplying the subtracted value by the modification variable, and adding the input image signal of the first pixel to the multiplied value.

* * * * *